US007509823B2

(12) United States Patent
Chen

(10) Patent No.: US 7,509,823 B2
(45) Date of Patent: Mar. 31, 2009

(54) METHOD FOR PRODUCING WINDPROOF AND AIR-PERMEABLE KNIT FABRIC

(75) Inventor: Kuo-Chin Chen, Sinjhuang (TW)

(73) Assignee: Singtex Industrial Co., Ltd., Taipei County (TW)

( * ) Notice: Subject to any disclaimer, the term of this patent is extended or adjusted under 35 U.S.C. 154(b) by 493 days.

(21) Appl. No.: 11/293,205

(22) Filed: Dec. 5, 2005

(65) Prior Publication Data

US 2007/0125130 A1 Jun. 7, 2007

(51) Int. Cl.
*D04B 9/42* (2006.01)

(52) U.S. Cl. ..... 66/202

(58) Field of Classification Search ..... 66/202, 66/191, 169 R, 170, 171; 26/29 R; 8/115.6, 8/115.7

See application file for complete search history.

(56) References Cited

U.S. PATENT DOCUMENTS

| | | | | | |
|---|---|---|---|---|---|
| 3,366,528 | A | * | 1/1968 | Takekawa | 428/85 |
| 4,521,458 | A | * | 6/1985 | Nelson | 427/294 |
| 5,474,839 | A | * | 12/1995 | Ogawa et al. | 442/80 |
| 5,626,950 | A | * | 5/1997 | Shimano et al. | 442/76 |
| H1978 | H | * | 8/2001 | Freiburger et al. | 156/78 |
| 6,316,373 | B1 | * | 11/2001 | Alexander et al. | 442/221 |
| H2011 | H | * | 1/2002 | Freiburger et al. | 604/381 |

* cited by examiner

*Primary Examiner*—Danny Worrell
(74) *Attorney, Agent, or Firm*—WPAT, Inc; Anthony King

(57) ABSTRACT

The present invention provides a method for producing a windproof and air-permeable single-layer knit fabric through several simple steps of designing, desizing, and brushing.

4 Claims, 7 Drawing Sheets

| Test No. | Color | Air permeability ($ft^3/ft^2xmin$) | Initial water repellency | Water repellency after 15 times of water-wash | Rain test (pass below 1g) |
|---|---|---|---|---|---|
| T7293 | Black | 32.1 | 80 | 80 | 11.50 |
| | Cerise | 33.6 | 90 | 90 | 12.00 |
| | Khaki | 31.6 | 80 | 80 | 10.80 |
| | Navy | 26.9 | 100 | 90 | 0.69 |
| T7316 | Orange | 27.2 | 100 | 90 | 0.29 |
| | Light purple | 25.6 | 100 | 90 | 0.34 |
| | Yellow | 26.1 | 100 | 90 | 0.20 |
| | Khaki | 27.3 | 100 | 90 | 0.09 |
| T7491 | Orange | 30.9 | 70 | - | 13.25 |
| | Orange | 28.1 | 100 | - | 0.09 |
| T7499 | Black | 33.7 | - | - | 18.13 |
| | Aquamarine | 28.6 | - | - | 0.31 |
| | Silver | 29.3 | - | - | 0.12 |
| T7601 | Yellow | 25.6 | 100 | 90 | 0.10 |
| | Black | 27.8 | 100 | 90 | 0.47 |
| | Dark brown | 26.9 | 100 | 90 | 0.15 |
| | Dark brown | 27.8 | - | - | 0.24 |
| | Aquamarine | 28.3 | - | - | 0.10 |
| | Aquamarine | 28 | 100 | 90 | 0.09 |
| | Aquamarine | 27.9 | - | - | 0.13 |
| | Aquamarine | 29.4 | - | - | 0.34 |
| | Cerise | 30.1 | 100 | 90 | 0.46 |
| | Cerise | 29.8 | - | - | 0.09 |
| | Cerise | 27.6 | - | - | 0.08 |
| | Orange | 31.9 | 100 | 90 | 0.08 |
| T7635 | Light khaki | 25.7 | 100 | 90 | 0.81 |
| T7704 | Black | 27.3 | 90 | 80 | 0.15 |
| | Red | 26.9 | 90 | 70 | 0.13 |
| | Yellow | 26.7 | 90 | 70 | 0.08 |
| | Sapphire blue | 29.1 | 90 | 80 | 0.38 |

FIG.3

METHOD FOR PRODUCING WINDPROOF AND AIR-PERMEABLE KNIT FABRIC

FIELD OF THE INVENTION

The present invention relates to producing a knit fabric; more particularly, relates to obtaining a windproof and rainproof single-layer knit fabric through a specific engineering.

DESCRIPTION OF THE RELATED ARTS(S)

A prior art, "a fast-dry and windproof functional fabric with high air permeability and high moisture permeability", is proclaimed in Taiwan, comprising an anion-base polyester fabric, a surface fabric and a TEFLON (Polytetrafluoroethylene) film. The TEFLON film is deposed between the polyester fabric and the surface fabric. The polyester fabric is a hydrophile fabric. And, the TEFLON film is waterproof, windproof and Vapor permeable.

Another prior art, "Waterproof and Moisture-permeable Elastic Fabric with Layers", is proclaimed in Taiwan, where, the elastic fabric comprises a layer of stretchable material having elastic essence; a polymer film with air permeability, water resist, and elasticity as that of the stretchable material; and an adhesive to adhere the layer of stretchable material to the polymer film with discontinuous segments.

A third prior art, "Moisture-Permeable Fabric with Environmental-Protection Water-base Resin and a Producing Method Thereof", is proclaimed in Taiwan, where a method for producing the fabric includes the following steps: (a) The fabric is gone through a general pre-process to obtain a pick-up rate of 5~25%. (b) A water-base resin is coated at the bottom in an amount of 70~200 g/m$^2$, a foaming rate of 1:3~1:7, and a drying temperature of 60~150° C. for 45 seconds to 1 minute; and is squeezed. (c) A water-base PU resin is coated in an amount of 100~150 g/m$^2$, a drying temperature of 60~150° C. per 0.5~1.5 minutes, and a heat-treatment temperature of 120~200° C. per 0.5~2.5 minutes. Consequently, an environmental protection fabric is obtained having a water-resistance more than 5000 mm. $H_2O$ and a moisture permeability more than 5000 g/m$^2$ /Day.

Although the above prior arts are waterproof, they comprises multi-layers so that the fabrics are thick and the producing methods are complex. Hence, the prior arts do not fulfill users' requests on actual use.

SUMMARY OF THE INVENTION

The main purpose of the present invention is to produce a windproof and rainproof single-layer knit fabric.

To achieve the above purpose, the present invention is a mothed for producing a windproof and air-permeable knit fabric, where the producing steps comprises designing the knit fabric with three parameters of characteristics; making a gray fabric; desizing the gray fabric together with impurities and greasiness on a surface of the knit fabric removed as well as a process of shrinking tremendously; going through a brushing engineering comprising a high density process, a brushing process and a napping process; and, after obtaining nano-scale naps on the surface of the knit fabric through the above brushing engineering, going through a finish process with a special agent to obtain a finished product which is rainproof, winproof and air-permeable and follows the regulations of AATCC35 and ASTM D737. Accordingly, a novel mothed for producing a windproof and air-permeable knit fabric is obtained.

BRIEF DESCRIPTIONS OF THE DRAWINGS

The present invention will be better understood from the following detailed descriptions of the preferred embodiments according to the present invention, taken in conjunction with the accompanying drawings, in which FIG. 1 is a view showing a flow chart according to a preferred embodiment of the present invention;

FIG. 3 is a view showing an examination result of a finished product according to the preferred embodiment of the present invention;

DESCRIPTION OF THE PREFERRED EMBODIMENT

The following description of the preferred embodiment is provided to understand the features and the structures of the present invention.

Figure 1:
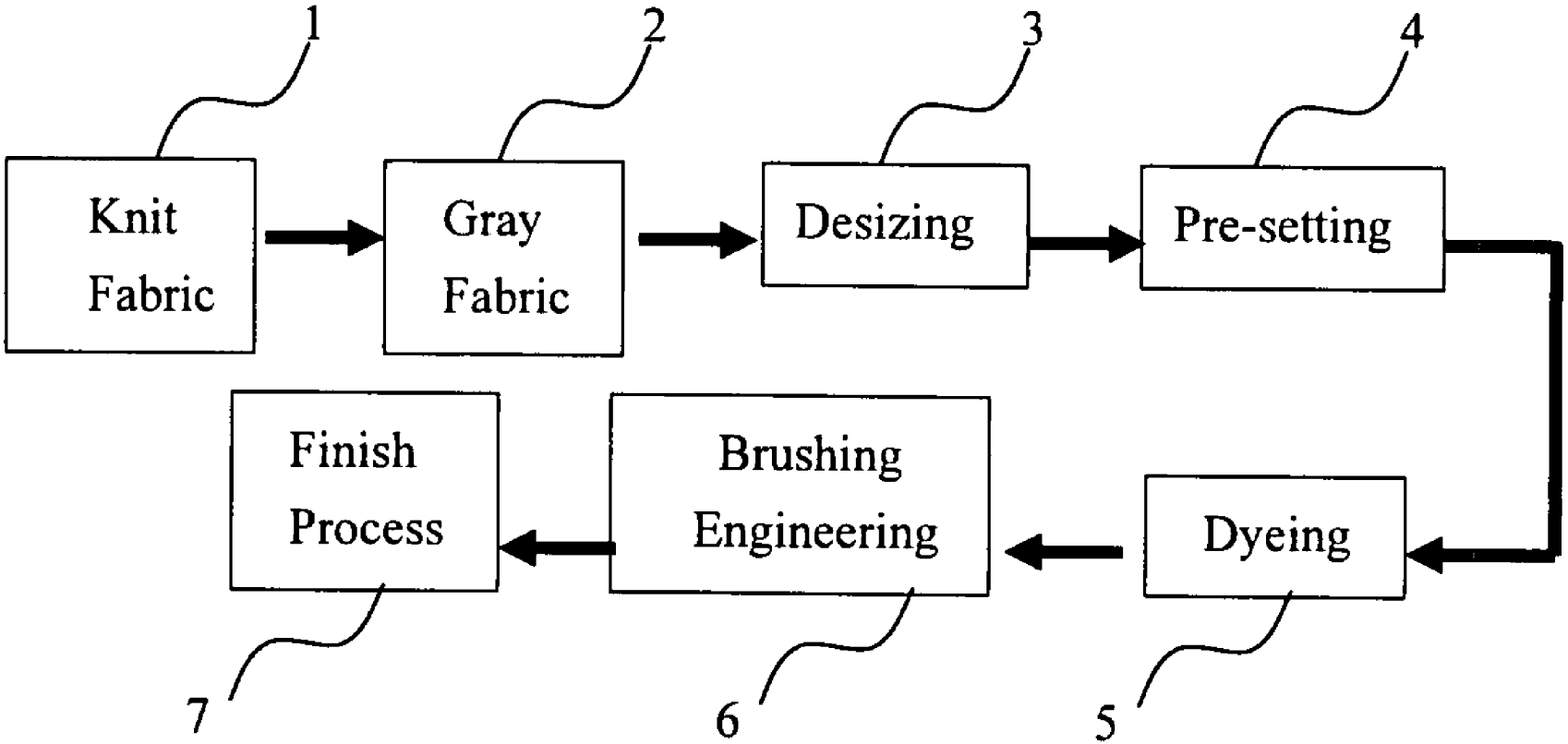

Please refer to FIG. 1, which is a view showing a flow chart according to a preferred embodiment of the present invention. As shown in the figure, the present invention is a mothed for producing a windproof and air-permeable knit fabric, comprising the following steps:

(a) Designing a knit fabric 1: Characteristics of the knit fabric are decided by using three parameters of a yarn count, a knitting and a yarn character. The yarn count is a value between 1 and 0.1 denier; the knitting comprises a parameter for obtaining a fabric with a high density between 40 and 45 courses per inch; and, the yarn character is a shrinkage rate between 30% and 50% in a boiling water.

(b) obtaining a gray fabric 2: The gray fabric is made by a machine according to the above three parameters.

(c) Desizing 3: Two processes are done: a process of removing impurities and greasiness on a surface of the knit fabric to obtain a clearer surface with fewer blemishes; and a process of shrinking tremendously to obtain thickness and elasticity.

(d) Pre-setting 4: The knit fabric is processed through a pre-setting 4 under a temperature between 170° C. and 190° C. after the desizing to avoid influence on the original structure while going through the following steps for making the knit fabric.

(e) Dyeing 5: The knit fabric after pre-setting is dipped into a dye stuff. The dyestuff is heated with water mixed. The knit fabric is stirred in the dyestuff to be dyed evenly. The dyed fabric is washed with a color fixing agent added to fix color.

Figure 2:
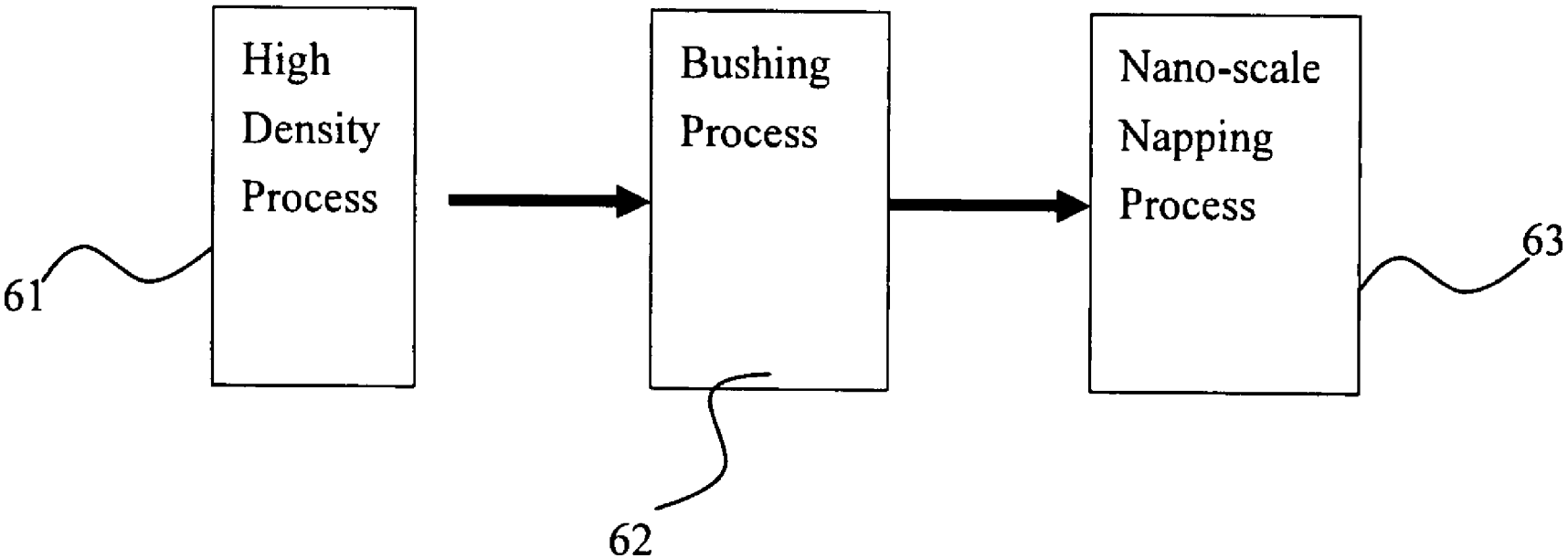
FIG. 2 is a view showing a flow chart of a brushing engineering according to the preferred embodiment of the present invention.
Figure 4:
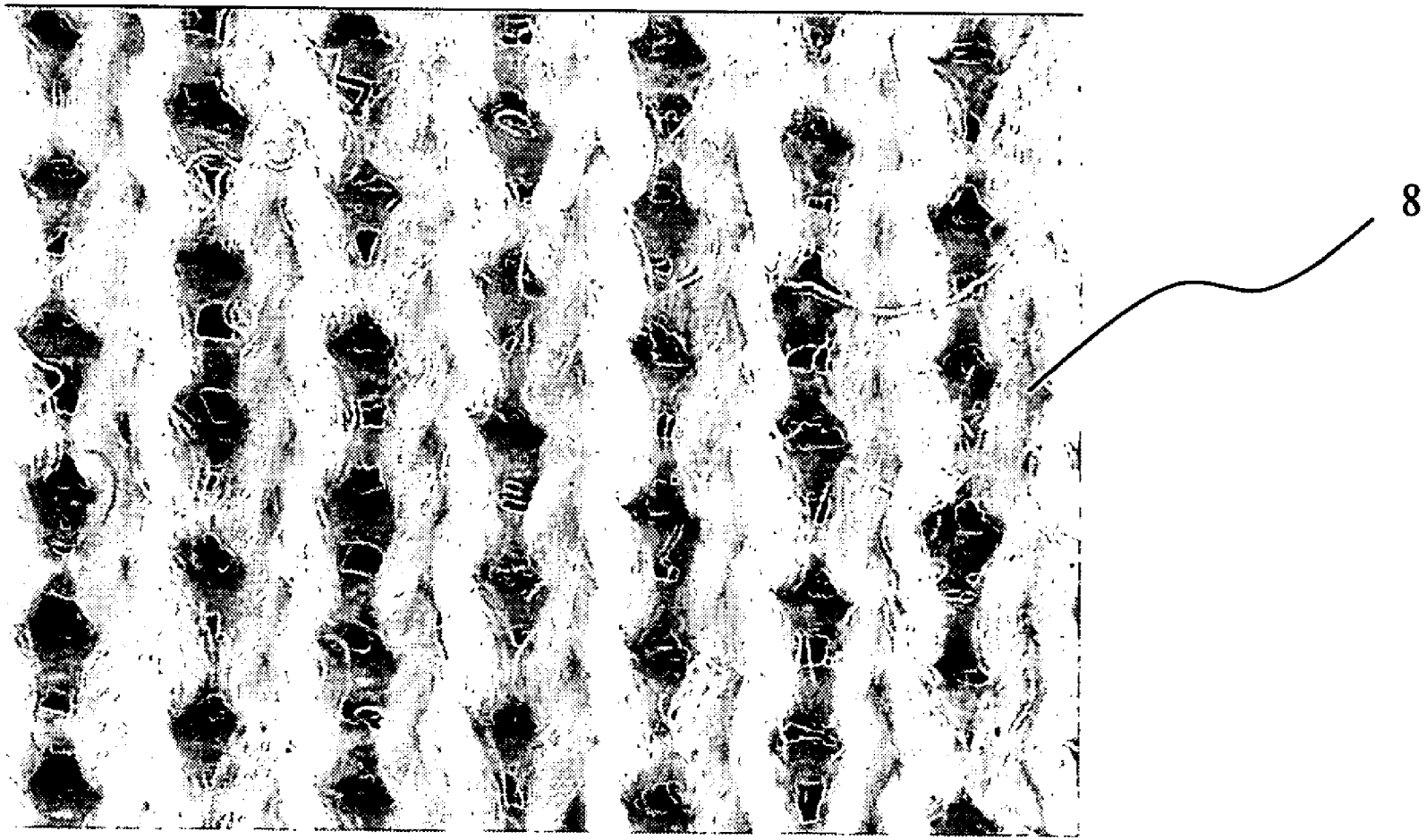
FIG. 4 is a view showing a knit fabric according to the preferred embodiment of the present invention.

(f) Going through a brushing engineering 6: The knit fabric after dyeing is gone through a brushing engineering to obtain a feel of hand. The brushing engineering comprises a plurality of processes to obtains a structure of the knit fabric to be windproof and waterproof with nano-scale naps of high density. Please refer to FIG. 2, which is a view showing a flow chart of the brushing engineering according to the preferred embodiment of the present invention. As shown in the figure, the brushing engineering comprises a plurality of processes, including a high density process 61, a brushing process 62 and a nano-scale napping process 63.

(g) Going through a finish process 7: The knit fabric after brushing engineering, which has nano-scale naps, is dipped in a special agent, which is a nano-scale fluoride, to obtain a windproof and rainproof surface.

Please refer to FIG. 3, which is a view showing an examination result of a finished product according to the preferred embodiment of the present invention. As shown in the figure, the finished product is gone through a windproof and air-permeability test. The windproof and air-permeability test follows the regulations of ASTM D737. The rain test follows the regulations of AATCC 35. The finished product is certificated by passing these tests. The finished product made with the above steps obtains characteristics of light-weight, comfortable feeling, rainproof and windproof surface, and elasticity. The knit fabric is rainproof for resisting a rain pressure below 600 mmhg and is windproof for resisting a wind pressure around 20~50 $ft^3/ft^2 \times min$.

Figure 5:
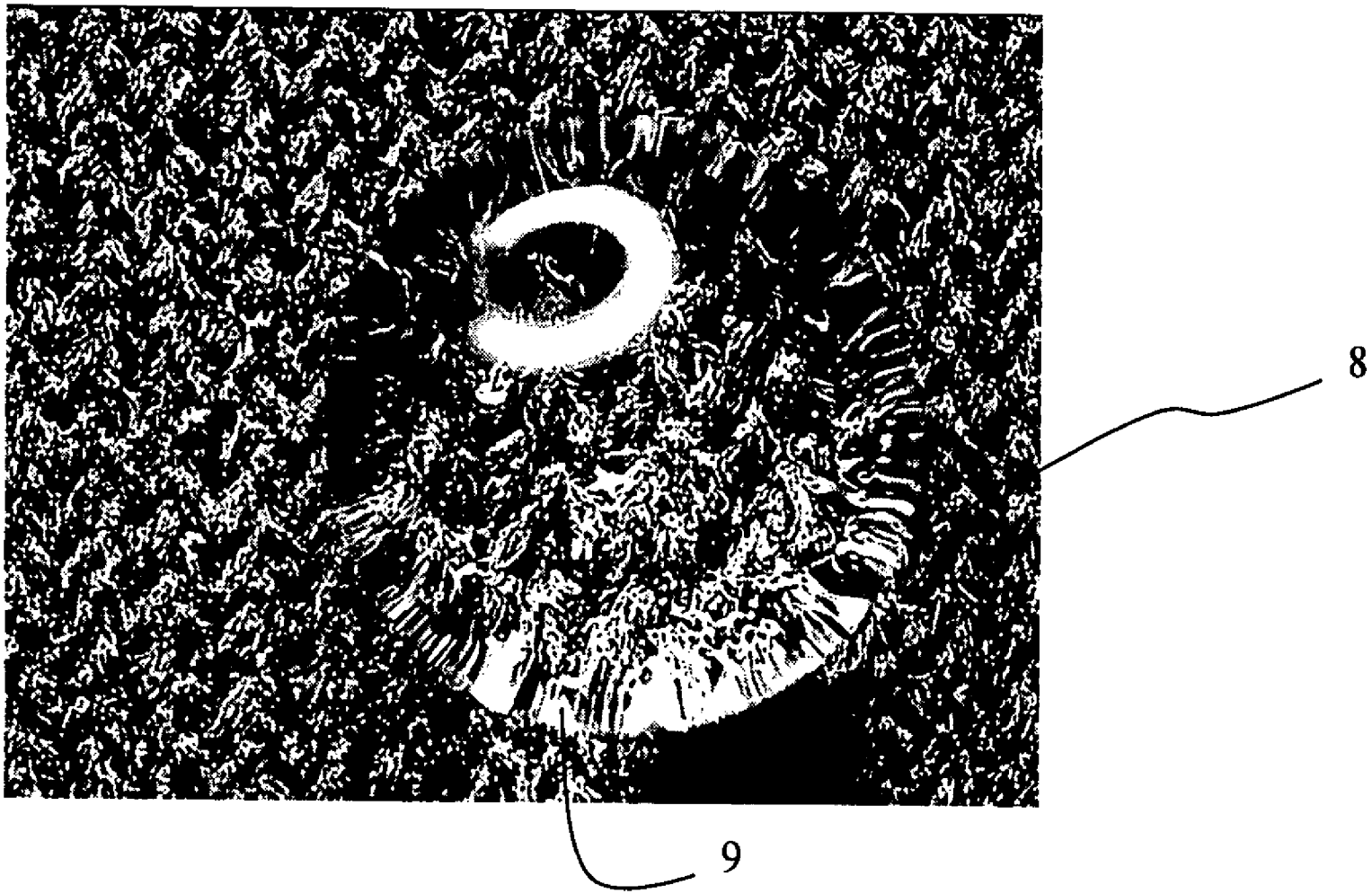
FIG. 5 is a view showing a rain test according to the preferred embodiment of the present invention.
Figure 6:
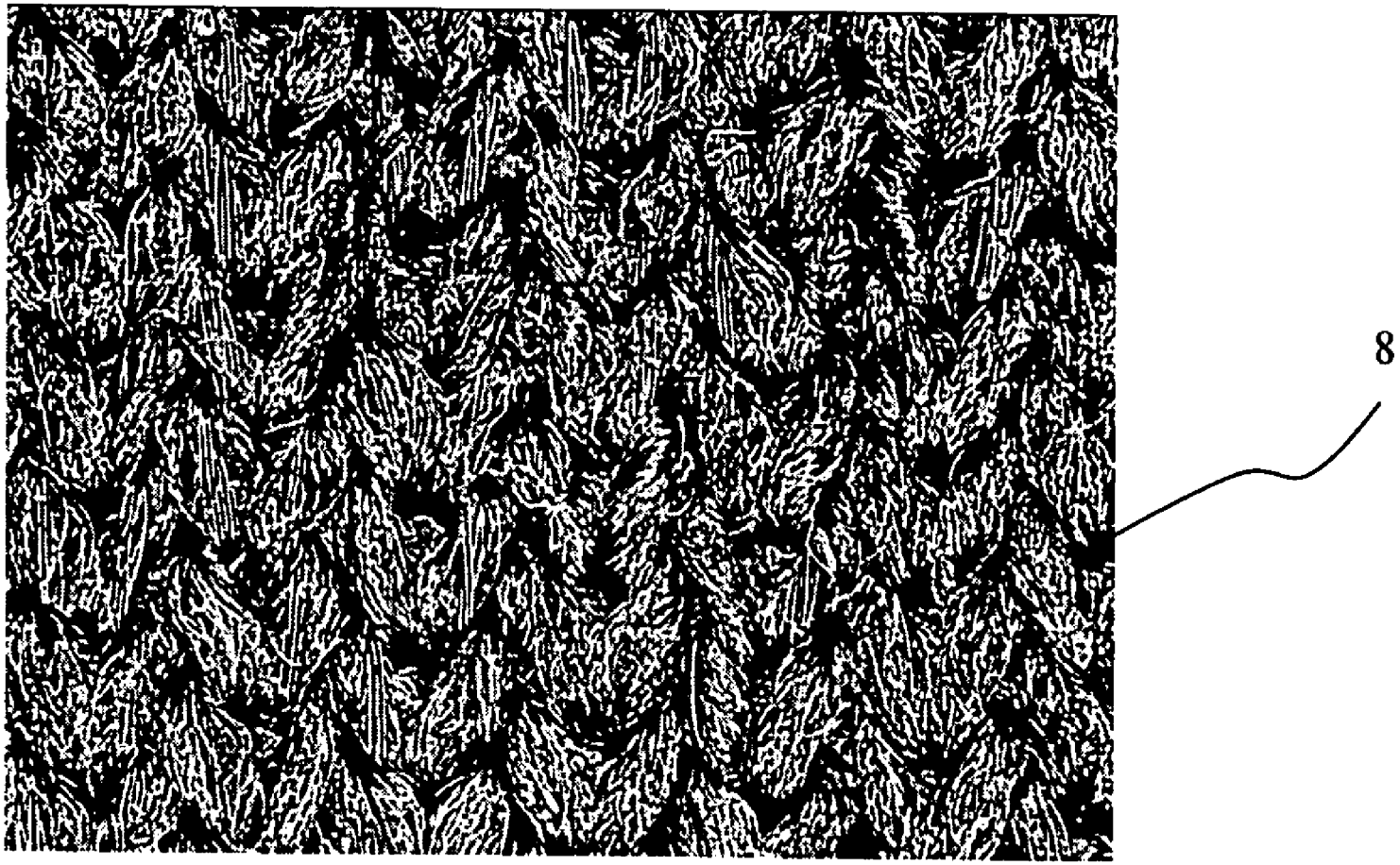
FIG. 6 is a view showing another knit fabric according to the preferred embodiment of the present invention.
Figure 7:
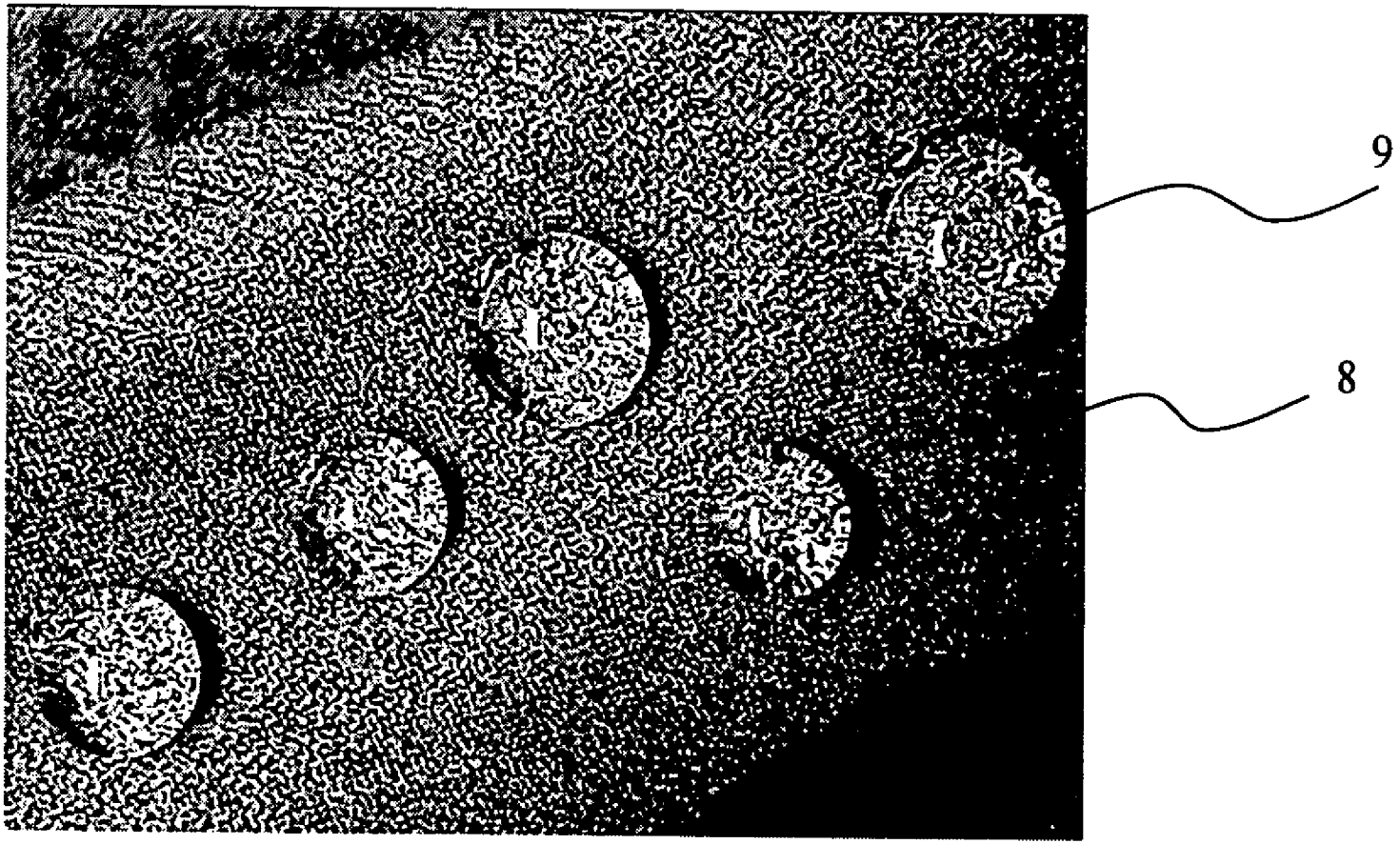
FIG. 7 is a view showing another rain test according to the preferred embodiment of the present invention.

Please refer to FIG. 4 through FIG. 7, which are views showing a knit fabric, a rain test, another knit fabric an d another rain test, according to the preferred embodiment of the present invention. As shown in FIG. 5 and FIG. 7, the finished products are gone through a rain test; the water drops 9 do not permeate through the finished fabric products 8; and, so, the finished fabric products 8 comprises a rainproof characteristic.

To sum up, the present invention is a mothed for producing a windproof and air-permeable knit fabric, where, through several simple steps of designing, desizing, and brushing, a windproof, rainproof and elastic knit fabric is produced.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A method for producing a windproof and air-permeable knit fabric, comprising steps of: (a) designing said knit fabric: with parameters of a yarn count between 1 and 0.1 denier, a knitting of 40 to 45 courses per inch, and a yarn shrinkage rate between 30% and 50% in a boiling water; (b) obtaining a gray fabric: made by a machine with said parameters; (c) desizing: shrinking said knit fabric together with a removal of impurities and greasiness on a surface of said knit fabric; (d) pre-setting: a heat setting operation under a temperature between 170.degree. C. and 190.degree. C. for said knit fabric after said desizing; (e) dyeing: by dipping said knit fabric into a dye stuff after said pre-setting step; (f) brushing engineering: a brushing treatment comprising a brushing process and a napping process; and (g) going through a finish process: by adding a nano-scale fluoride to said knit fabric after said brushing engineering step.

2. The method according to claim 1, wherein said knit fabric is a filament fabric having shrinkage capability.

3. The method according to claim 1, wherein a surface of said knit fabric after said brushing engineering is a surface having nano-scale naps.

4. The method according to claim 1, wherein said knit fabric becomes thick and elastic after said desizing.

* * * * *